US006418588B1

(12) United States Patent
Haab et al.

(10) Patent No.: US 6,418,588 B1
(45) Date of Patent: Jul. 16, 2002

(54) SUSPENSION DEVICE

(75) Inventors: Karl Haab, Weggis; Otto Haab, Mettmenstetten, both of (CH)

(73) Assignee: Hawa AG, Mettmenstetten (CH)

( * ) Notice: Subject to any disclaimer, the term of this patent is extended or adjusted under 35 U.S.C. 154(b) by 0 days.

(21) Appl. No.: 09/673,172

(22) PCT Filed: Mar. 14, 2000

(86) PCT No.: PCT/CH00/00146

§ 371 (c)(1),
(2), (4) Date: Oct. 12, 2000

(87) PCT Pub. No.: WO00/65186

PCT Pub. Date: Nov. 2, 2000

(30) Foreign Application Priority Data

Apr. 27, 1999 (CH) ..... 773/99

(51) Int. Cl.[7] ..... E05D 15/00
(52) U.S. Cl. ..... 16/91; 16/87.2; 49/409
(58) Field of Search ..... 16/91, 87.2, 105; 49/409, 413, 421

(56) References Cited

U.S. PATENT DOCUMENTS

| | | | | |
|---|---|---|---|---|
| 2,207,322 | A | * | 7/1940 | Long |
| 2,917,771 | A | * | 12/1959 | Labrie |
| 3,829,929 | A | * | 8/1974 | Folz et al. |
| 4,288,887 | A | * | 9/1981 | Johnson |
| 4,945,605 | A | * | 8/1990 | Haab et al. |
| 5,461,829 | A | * | 10/1995 | Lehto et al. |
| 5,907,890 | A | * | 6/1999 | Redaelli |
| 6,209,171 | B1 | * | 4/2001 | Pelletie et al. |

FOREIGN PATENT DOCUMENTS

| | | |
|---|---|---|
| CH | 430 486 A | 12/1965 |
| EP | 0 502 285 A | 9/1992 |
| EP | 0679788 | 11/1995 |
| EP | 0733766 | 9/1996 |
| EP | 0 753 637 A | 1/1997 |

* cited by examiner

*Primary Examiner*—Anthony Knight
*Assistant Examiner*—Mark Williams
(74) *Attorney, Agent, or Firm*—Oliff & Berridge, PLC

(57) ABSTRACT

The suspension device which serves to connect a door element (2) to a running mechanism (6) guided in a rail (4) has a securing means (30) which can be connected to the door element (2), and a connecting screw (10) which is provided with a screw head (11) and a shank (12–15), can be fitted into the securing means (30) and screwed into a threaded drill-hole (9) provided in the running mechanism (6). The securing means (30) has two wing elements **(32*a*, 32*b*) which can be connected to the door element (2) and which are connected by a central piece (33) which is provided with a recess (34) and is bent upward relative to the wing elements (32*a*, 32*b*) in such a manner that, after the securing means (30) is installed, the screw head (11) can be guided through under the central piece (33), so that the shank (12–15) can be introduced into the recess (34), which is adjoined by a collar (35) serving to hold the screw head (11). The suspension device, which can be produced cost-effectively and fitted and adjusted with little outlay, only requires a little space, so that the door element (2) can be fitted at a small distance from the running mechanism (6) and rail (4)**.

8 Claims, 3 Drawing Sheets

Figure 3:
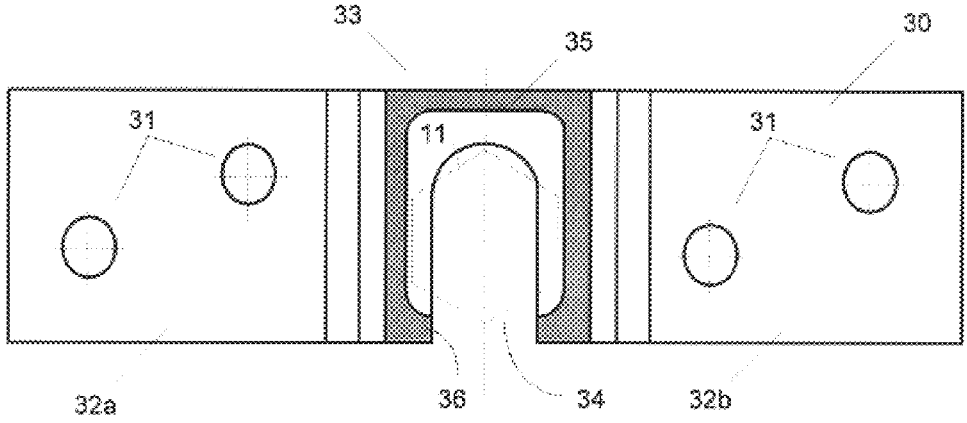

Fig. 1
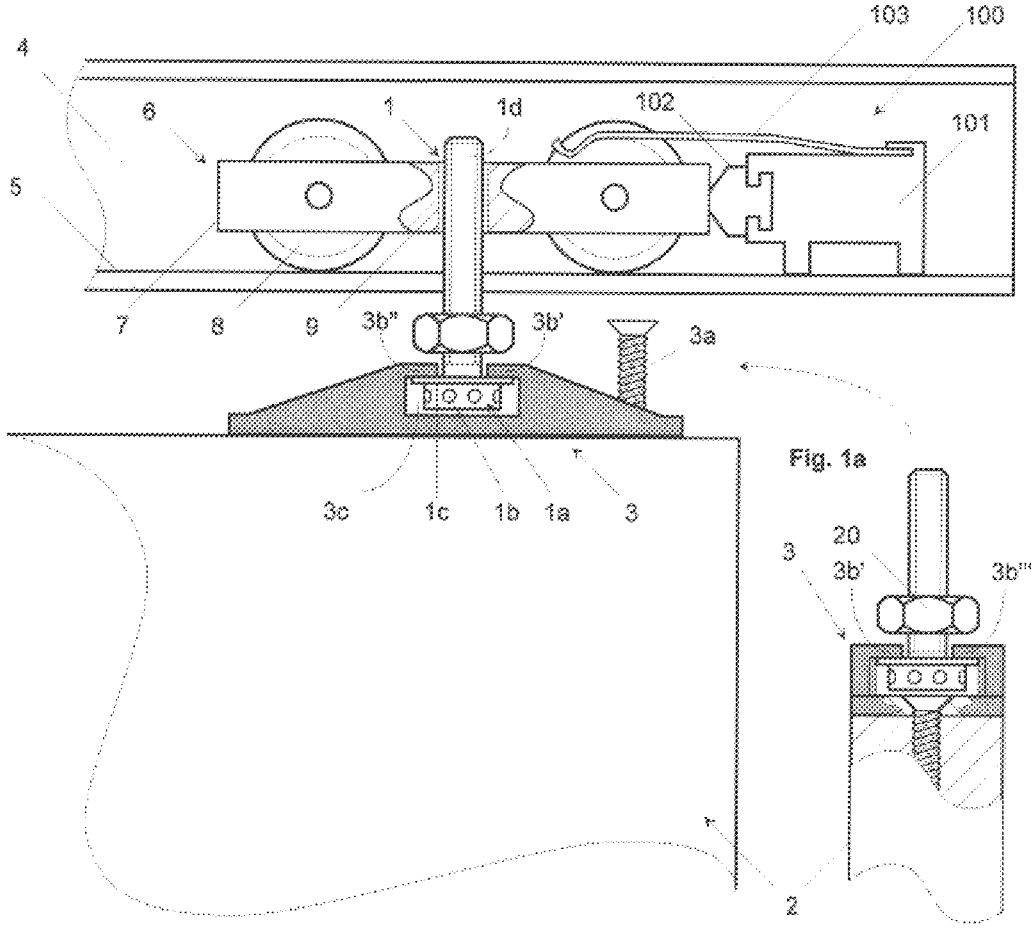
Fig. 1a
Fig. 2
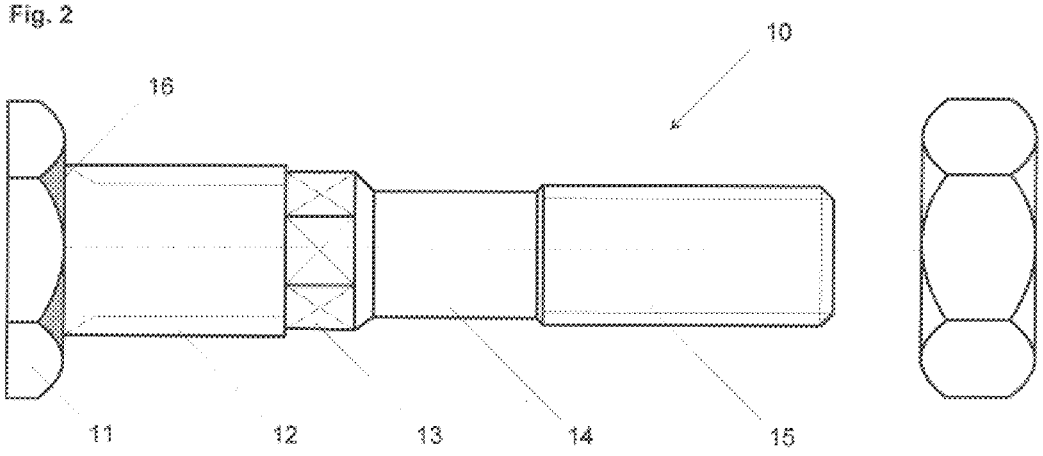

SUSPENSION DEVICE

The invention relates to a suspension device.

In order to close off or divide rooms use is frequently made of sliding doors which, as shown in FIG. 1, are connected to a running mechanism 6 guided in a rail. Running mechanisms of this type are described, for example, in EP 0 733 766 or EP 0 679 788. The normally U-profile-shaped rail 4 has running surfaces 5 along which the rollers 8 of the running mechanism 6 are guided. A buffer device 100 is furthermore provided in the rail 4, by means of which buffer device the running mechanism 6 can be cushioned and secured. For this purpose, the body 101 of the buffer device 100 has an elastic element 102 and a retaining spring 103 which, in FIG. 1, engages in a hub diameter provided in the rollers 8 and consequently secures the running mechanism 6 at the end of the rail.

The door element 2 which is shown in FIG. 1 is connected to the running mechanism 6 by a connecting screw 1 which is screwed at one end into a threaded drill-hole 9 provided in the running mechanism 6 and at the other end is fitted with the head piece 1*a* into a securing means 3 which is attached to the upper side of the door element 2 by screws 3*a*. The securing means 3 shown has upwardly directed clasp elements 3*b*', 3*b*", 3*b*'" which enclose a cavity 3*c* into which the head 1*a* of the connecting screw 1 can be introduced frontally or else, as shown in FIG. 1*a*, laterally. The head 1*a* of the connecting screw 1 is provided with drill-holes 1*b* and is connected to a square plate 1*c* which bears against the clasp elements 3*b*', 3*b*", 3*b*'". A tool can be inserted into the drill-holes 1*b* and can be used to rotate the head 1*a* until the connecting screw 1, or the distance of the door element 2 from the rail 4, is correctly adjusted. However, each time the tool is inserted, with the result that the connecting screw 1 can only be rotated by about 90°, with the result that the adjustment procedure takes up a considerable amount of time. During the adjustment procedure the screw head 1*a* is generally displaced within the cavity 3*c*, with the result that the door element 2 has to be realigned before the connecting screw 1 can be fixed by a screw nut 20.

In addition, the securing means 3 is a diecast part which has to be produced with a correspondingly high outlay. Furthermore, diecast parts are generally sensitive to impact and are not corrosion resistant. In this arrangement, the relatively delicate clasp elements 3*b*', 3*b*", 3*b*'", which are subjected to a high load, are particularly at risk. So that the head 1*a* of the connecting screw 1 is of a sufficient strength and can be grasped with a tool, it has to be manufactured in an appropriate size. This results in an installation height for the securing means 3 that requires a relatively large distance between the rail 4 and securing means 3 or door element 2.

The present invention is therefore based on the object of providing a cost-effective and stable suspension device for a door element, which device can be produced from rust-free materials, can be fitted in a simple manner, can easily be adjusted and can be connected in such a manner to a running mechanism guided in a rail that only a small distance is required between the door element and rail.

This object is achieved by the measures specified in claim 1. Advantageous refinements of the invention are specified in further claims.

The suspension device comprises a connecting screw and a securing means which can both be produced cost-effectively. The securing means can be manufactured by punching from a metal plate in a few working steps. The space required by the securing means between the door element and running mechanism is extremely small and corresponds approximately to twice the height of the head piece of the connecting screw, which can easily be adjusted stepwise after the door element provided with the securing means is fitted, and can be arrested, without the securing means being laterally displaced. It is particularly advantageous that the tool provided for the adjustment procedure does not act on the relatively narrow head, but on the easily accessible shank of the connecting screw.

Figure 4:
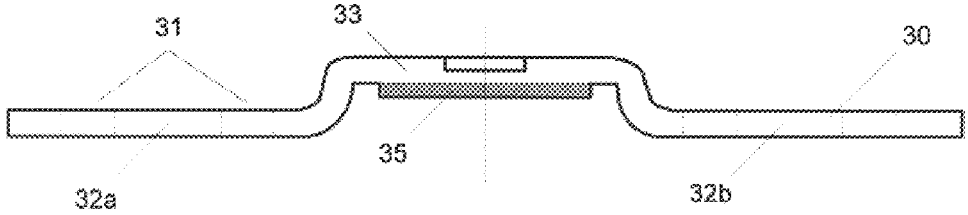
Figure 5:
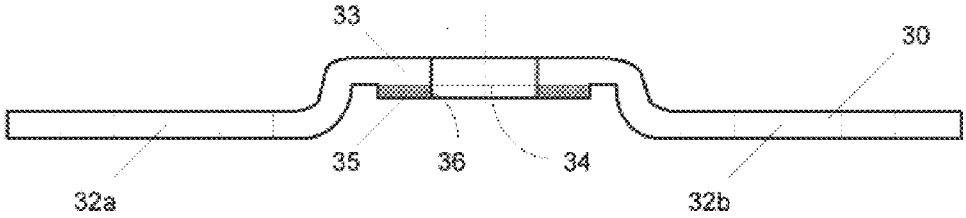
Figure 6:
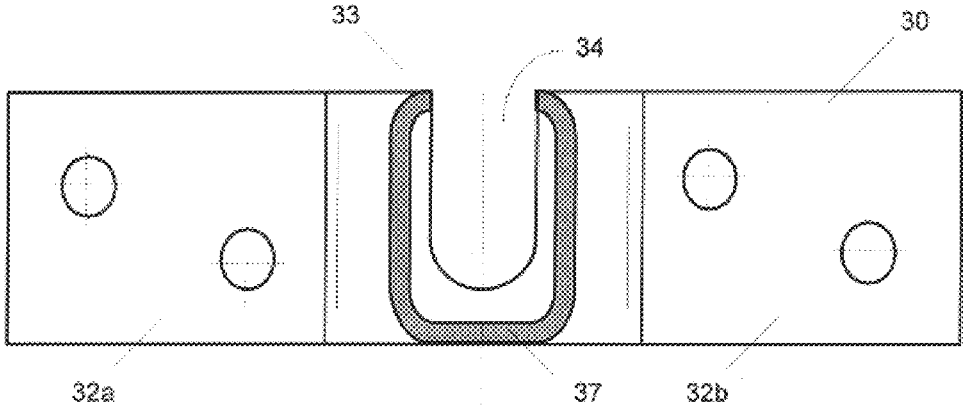
Figure 7:
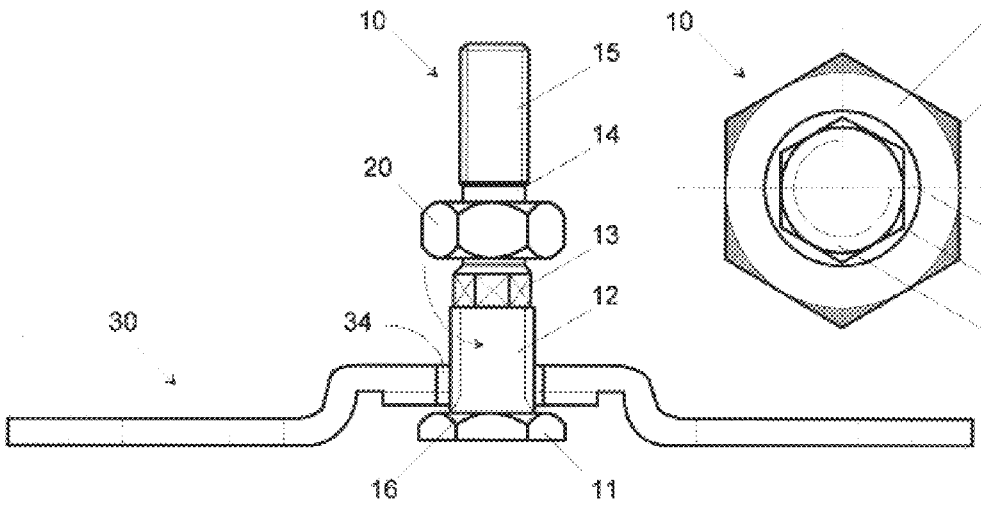
Figure 8:
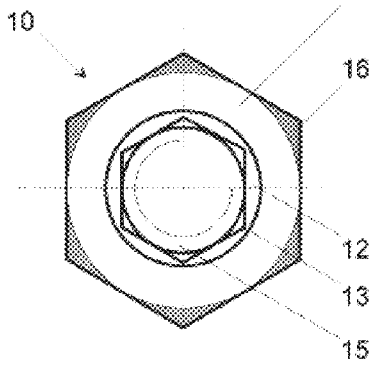
Figure 9:
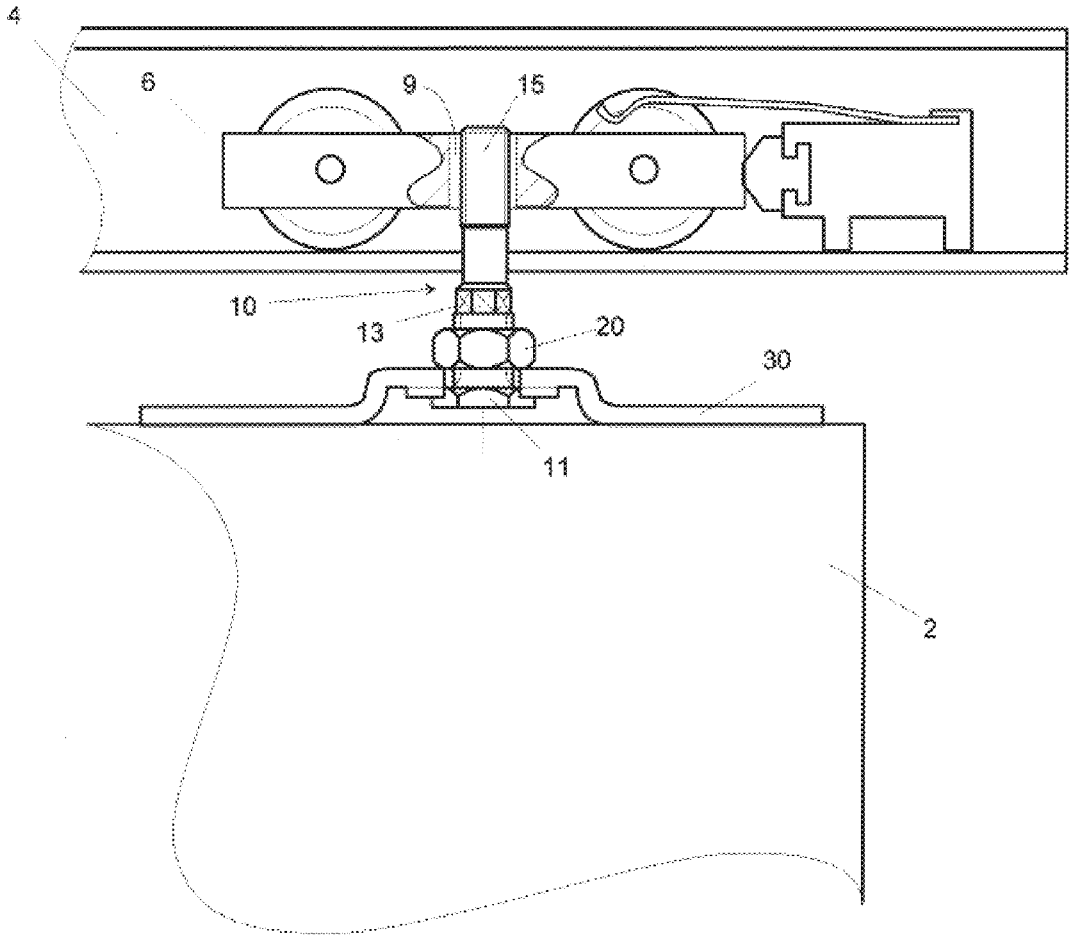

In the following, the invention is explained in more detail with reference to a drawing, in which:

FIG. 1 shows a known suspension device by which a door element 2 is connected to a running mechanism 6 guided in a rail 4, FIG. 2 shows a connecting screw 10 according to the invention having a screw nut 20 serving to arrest the device, FIG. 3 shows a securing means 30 according to the invention, as seen from below, FIG. 4 shows the securing means 30 according to FIG. 3, as seen from the rear side, FIG. 5 shows the securing means 30 according to FIG. 3, as seen from the front side, FIG. 6 shows the securing means 30 according to FIG. 3, as seen from above, FIG. 7 shows the securing means 30 according to FIG. 3 during its fitting to the connecting screw 10, FIG. 8 shows the connecting screw 10, as seen from the front, and FIG. 9 shows the suspension device according to the invention by which a door element 2 is connected to a running mechanism 6 guided in a rail 4.

FIG. 1 shows the suspension device which is described at the beginning and by which a door element 2 is connected to a running mechanism 6 which is guided in a rail 4. The normally U-profile-shaped rail 4 has running surfaces 5 along which the rollers of the running mechanism 6 are guided. A buffer device 100 is furthermore provided in the rail 4, by means of which buffer device the running mechanism 6 can be cushioned and secured. The door element 2 is connected to the running mechanism 6 by a connecting screw 1 which is screwed at one end into a threaded drill-hole 9 provided in the running mechanism 6 and at the other end is fitted with the head piece into the securing means 3 described at the beginning. In order to avoid the deficiencies of this known device, suspension devices according to the invention are proposed, which devices each comprise a connecting screw 10 and a securing means 30, as are shown in FIG. 2 and FIGS. 3 to 6, respectively. The manner in which the connecting screw 10 and the securing means 30 are connected to each other and also to the running mechanism 6 and the door element 2 can be seen in FIG. 7 and FIG. 9.

The suspension device according to the invention is explained in detail in the following with reference to the drawings. The securing means 30 which is shown in FIGS. 3 to 6 comprises a central piece 33 which is connected on both sides to a wing element 32*a*, 32*b*. The wing elements 32*a*, 32*b* have drill-holes 31 through which screws can be guided which serve to connect the securing means 30 to the door element 2.

It can be seen from FIG. 4 and FIG. 5 that the zones between the central piece 33 of the two wing elements, 32*a*, 32*b* are bent in such a manner that the central piece 33 is raised to a sufficient extent with respect to the wing elements 32*a*, 32*b* that the head 11 of the connecting screw 10 can be introduced below the central piece 33 after the securing means 30 is installed. Since it is the shank 13 and not the head 11 of the connecting screw 10 which has to be grasped for the adjustment procedure, said shank can be selected such that it is relatively narrow.

In order to hold the connecting screw 10, the central piece 33 has a recess 34 into which the shank 12–15 of the connecting screw 10 can be introduced. Furthermore, on the lower side the central piece 33 has a collar 35 into which the head 11 of the connecting screw 10 can be sunk (see FIG. 3). In this arrangement, the ends of the collar 35, which ends adjoin the entrance to the recess 34, prevent the head 11 of the connecting screw 10 grasped by the collar 35 from slipping out of the recess 34 again. It can be seen in FIG. 9 that the head 11 of the connecting screw 10 is pressed into the collar 35 because of the weight of the door element 2. Only by raising the door element 2 can the head 11 of the connecting screw 10 be detached again from the collar 35. As a result, the door element 2 is reliably secured right after it is fitted.

Owing to the material requirements for the collar 35, during the manufacture of the securing means 30 material is displaced downward in a channel 37 from the upper side, shown in FIG. 6, of the central piece 33, and is pressed on the lower side into a shape forming the collar 35. The securing means 30, including the recess 34, can therefore be punched in a simple manner from a metal plate, provided with the collar 35 and bent. The collar 35 furthermore prevents the head 11 of the connecting screw 10 from being able to rotate automatically, for example when the door element 2 is knocked or when vibrations occur. However, by means of a particularly advantageous requirement of the connecting screw 10 described in the following it is possible to adjust and arrest the connecting screw 10 in a simple manner.

FIG. 2 shows the connecting screw 10 according to the invention and comprising a head 11 and a shank 12–15. The shank 12–15 essentially comprises three parts 12, 13 and 15 which are stepped with respect to one another and between which transition pieces 14, provided if appropriate to extend the shank 12–15, are provided. The stepping of the parts 12, 13 and 15 can also be seen particularly well in FIG. 8, in which the connecting screw 10 is shown from the front.

The front part 12 of the shank 12–15, which front part bears against the screw head 11 and has the largest diameter, preferably has a thread for a screw nut 20 which, as shown in FIG. 9, serves to arrest the connecting screw 10, so that the screw head 11 is held immovably in the collar 35 after installation.

The end part 15 of the shank 12–15, which end part is likewise provided with a thread and has a smaller diameter, serves for the connection to the running mechanism 6. In this arrangement, the end part 15 of the shank 12–15 can be screwed into the threaded drill-hole 9 until the desired distance is set between the door element 2 and running mechanism 6.

The central part 13 provided between the front part 12 and end part 15 is configured in such a manner that it can be grasped by a tool, held and rotated in order to adjust the distance between the door element 2 and running mechanism 6. The central part 13 is preferably in the form of a hexagon screw head (similar to the screw head 11) which can be grasped by a wrench.

Of particular interest is the preferably hexagon-shaped screw head 11, which is provided on the side facing the shank 12–15 with rounded-off areas 16 which enable the screw head 11 to rotate in the collar and to adjust the suspension device. For this purpose, the screw nut 20 is loosened, after which the central part 13 is grasped and rotated. The rounded-off areas 16 prevent the screw head 11 from tilting in the collar 35 and blocking. During rotation of the central part 13, the screw head 11 is pressed out of the collar 35 for each sixth of a revolution and rotated without being laterally displaced. The connecting screw 10, which is roughly set before installation, can therefore be precisely set after installation by means of a wrench. No lateral adjustment is therefore required after the door element 2 has been adjusted vertically.

After the vertical adjustment of the door element 2, the connecting screw 10 is preferably arrested by a screw nut 20. Because of the weight of the door element 2, by which the screw head 11 is pressed into the collar 35, it is sometimes also possible to dispense with arresting.

It can be seen from FIG. 7 and FIG. 9 that the suspension device according to the invention requires only a small space. The wing elements 32*a*, 32*b* are preferably fastened on the upper side of the door element 2 by screws. Between the door element 2 and the running mechanism 6 which is guided in the rail 4 space is only provided for the screw nut 20, which is provided in order to arrest the device, and the central part 13, which serves to adjust the device. If the arresting by the screw nut 20 is dispensed with, there is a minimal distance between the door element 2 and rail 4 of a few millimeters.

What is claimed is:

1. A suspension device which serves to connect a door element (2) to a running mechanism (6) guided in a rail (4), having a securing means (30) which can be connected to the door element (2), and having a connecting screw (10) which has a screw head (11) and a shank (12–15) and which can be fitted into the securing means (30) and screwed into a threaded drill-hole (9) provided in the running mechanism (6), wherein the securing means (30) has two wing elements (32*a*, 32*b*) which can be connected to the door element (2) and which are connected by a central piece (33) which is provided with a recess (34) and is bent upward relative to the wing elements (32*a*, 32*b*) in such a manner that, after the securing means (30) is installed, the screw head (11) can be guided through under the central piece (33), so that the shank (12–15) can be introduced into the recess (34), which is adjoined by a collar (35), located on a lower side of the central piece 33, serving to hold the screw head (11) and into which the screw head (11) of the connecting screw (10) can be sunk, and wherein the shank (12–15) has:

a front part (12) which is provided with a thread and serves to hold a screw nut (20) which is used to arrest the connecting screw (10), an end part (15), which can be screwed into the threaded drill-hole (9) of the running mechanism (6), and a central part (13) which is configured in such a manner that it can be grasped, held and rotated by a tool, and wherein the end part (15), the central part (13) and the front part (12) are stepped with respect to one another in such a manner that the screw nut (20) can be slid over the end part (15), and central part (13).

2. The suspension device as claimed in claim 1, wherein the wing elements (32*a*, 32*b*) are provided for installation on the upper side of the door element (2) and for this purpose are provided with drill-holes (31) which serve for running the fastening screws through.

3. The suspension device as claimed in claim 1, wherein the collar (35) is configured in such a manner that, after the connecting screw (10) is fitted, said collar surrounds the screw head (11) to an extent sufficient to keep the shank (12–15) retained within the recess (34).

4. The suspension device as claimed in claim 1, wherein between the end part (15), the central part (13) and the front part (12), at least one transition part (14) is provided, which is stepped with respect to the front part (12) in such a manner that the screw nut (20) can be slid over the transition part (14).

5. The suspension device as claimed in claim 1, wherein the screw head (11) is rounded off on the shank side.

6. The suspension device as claimed in claim 1, wherein the securing means (30) is manufactured by punching and pressing from a preferably corrosion-resistant metal element.

7. The suspension device as claimed in claim 6, wherein that side of the securing means (30) which lies opposite the collar (35) has a pressed-in channel (37) from which the material has been displaced toward the collar (35).

8. The suspension device as claimed in claim 1, wherein ends of the collar (35) adjoin the entrance to the recess (34), preventing the screw head (11) of the connecting screw (10) that is grasped by the collar (35) from slipping out of the recess.

* * * * *